US011691418B2

(12) United States Patent
Uchida

(10) Patent No.: US 11,691,418 B2
(45) Date of Patent: Jul. 4, 2023

(54) LIQUID EJECTING HEAD AND LIQUID EJECTING APPARATUS

(71) Applicant: SEIKO EPSON CORPORATION, Tokyo (JP)

(72) Inventor: Kazuaki Uchida, Suwa-gun Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 143 days.

(21) Appl. No.: 17/235,454

(22) Filed: Apr. 20, 2021

(65) Prior Publication Data

US 2021/0237441 A1 Aug. 5, 2021

Related U.S. Application Data

(63) Continuation of application No. 16/555,728, filed on Aug. 29, 2019, now abandoned.

(30) Foreign Application Priority Data

Aug. 30, 2018 (JP) ..... 2018-161128

(51) Int. Cl.
*B41J 2/055* (2006.01)
*B41J 2/14* (2006.01)

(52) U.S. Cl.
CPC ..... *B41J 2/055* (2013.01); *B41J 2/1433* (2013.01); *B41J 2/14201* (2013.01); *B41J 2202/12* (2013.01)

(58) Field of Classification Search
None
See application file for complete search history.

(56) References Cited

U.S. PATENT DOCUMENTS

2015/0085032 A1* 3/2015 Ando ..... B41J 3/543 347/90
2016/0311221 A1* 10/2016 Menzel ..... B41J 2/14233
2017/0096015 A1 4/2017 Odaka et al.
2018/0272709 A1 9/2018 Iwata et al.
2019/0329559 A1 10/2019 Ozawa

FOREIGN PATENT DOCUMENTS

JP 2006-088493 A 4/2006
JP 2015-147374 8/2015
JP 2016-010862 A 1/2016
JP 2017-065249 4/2017
JP 2018-103418 7/2018

* cited by examiner

*Primary Examiner* — Justin Seo
(74) *Attorney, Agent, or Firm* — Workman Nydegger

(57) ABSTRACT

A liquid ejecting head includes nozzles configured to eject liquid, pressure chambers communicating with the nozzles, the pressure chambers being configured to generate pressure for ejecting the liquid, a first liquid chamber configured to store the liquid to be supplied to the pressure chambers, a second liquid chamber configured to store the liquid that passed through the pressure chambers, first communication paths communicating with the pressure chambers from the first liquid chamber, second communication paths respectively communicating with the second liquid chamber from between the pressure chambers and the nozzles in which flow path resistance in the first communication paths is higher than flow path resistance in the second communication paths.

10 Claims, 7 Drawing Sheets

LIQUID EJECTING HEAD AND LIQUID EJECTING APPARATUS

This application is a continuation of U.S. patent application Ser. No. 16/555,728, filed Aug. 29, 2019, which claims priority from JP Application Serial Number 2018-161128, filed Aug. 30, 2018, the disclosures of which are hereby incorporated by reference herein in their entirety.

BACKGROUND

1. Technical Field

The present disclosure relates to a liquid ejecting head such as an ink jet recording head and a liquid ejecting apparatus including the liquid ejecting head. In particular, the present disclosure relates to a liquid ejecting head through which a liquid is circulated toward a liquid storing section, and a liquid ejecting apparatus including the liquid ejecting head.

2. Related Art

Liquid ejecting apparatuses are provided with a liquid ejecting head, and from the liquid ejecting head, eject (discharge) various kinds of liquids as liquid droplets. Examples of the liquid ejecting apparatuses include image recording apparatuses such as ink jet printers and ink jet plotters. In recent years, the liquid ejecting apparatuses have been applied to various manufacturing apparatuses by taking advantage of the ability to accurately eject a very small amount of liquid to predetermined positions. For example, the liquid ejecting apparatuses are applied to display-manufacturing apparatuses for manufacturing color filters for liquid crystal displays and the like, electrode-forming apparatuses for forming electrodes for organic electro luminescence (EL) displays, field emission displays (FEDs), and the like, and chip-manufacturing apparatuses for manufacturing biochips (biochemical elements). For example, recording heads for image recording apparatuses eject a liquid containing a coloring material, and color material ejecting heads for manufacturing displays eject liquids containing coloring materials of red (R), green (G), and blue (B). Electrode-material ejecting heads for electrode-forming apparatuses eject liquids containing materials, and bioorganic-compound ejecting heads for chip-manufacturing apparatuses eject liquids containing bioorganic compounds.

Some of the above-described liquid ejecting heads include a nozzle plate having a plurality of nozzles, a plate having a plurality of pressure chambers (may be referred to as pressure generation chambers or cavities) communicating with corresponding nozzles, a plate having a common liquid chamber (may be referred to as a reservoir or a manifold) that is commonly used by the pressure chambers and into which a liquid from a liquid storage section is introduced, and pressure generating sections (may be referred to as driving elements or actuators) such as piezoelectric elements that cause pressure vibration in the liquid in the pressure chambers. Some other liquid ejecting heads employ a structure having a circulation flow path communicating with pressure chambers and nozzles, and a liquid circulates through a liquid storage section and the liquid ejecting head. In such structures, for example, JP-A-2016-010862 discusses a circulation structure in which a minimum opening length in the flow path cross section of a flow channel on an upstream side (that is, a supply side) of a nozzle and a minimum opening length in the flow path cross section of a flow path on a downstream side (that is, a discharge side) are appropriately designed so as to ensure the discharge stability by ink circulation.

In continuously ejecting liquid droplets from nozzles, particularly, in ejecting a liquid from nozzles with an increased number of droplet ejection per unit time at a higher driving cycle, the nozzles need to be refilled with the liquid more quickly, that is, the performance for refilling the nozzles with the liquid needs to be increased. In this respect, it is desirable that the flow path resistance be as low as possible. Meanwhile, in order to suppress the fluctuations in the amount of liquid droplets ejected from the nozzles and the flying speed to more stably eject the liquid, among the pressure vibrations generated in the ejection, it is desirable to reduce the vibration (hereinafter, referred to as residual vibration) remaining in the liquid in the flow path after ejecting the liquid droplets as much as possible. Such a residual vibration can be attenuated by increasing the flow path resistance. Accordingly, with regard to the design of the flow path resistance in the flow path of the liquid ejecting head, there is a trade-off between the capability of refilling the nozzles with the liquid and the attenuation of the residual vibration.

SUMMARY

An advantage of some aspects of the present disclosure is that there is provided a liquid ejecting head and a liquid ejecting apparatus capable of increasing the performance of refilling nozzles with liquid and reducing residual vibration.

A liquid ejecting head according to an aspect of the present disclosure includes nozzles configured to eject liquid, pressure chambers communicating with the nozzles, the pressure chambers being configured to generate pressure for ejecting the liquid, a first liquid chamber that is a common liquid chamber communicating with the pressure chambers, a second liquid chamber that is a common liquid chamber communicating with the pressure chambers, first communication paths communicating with the pressure chambers from the first liquid chamber, second communication paths respectively communicating with the second liquid chamber from between the pressure chambers and the nozzles, in which flow path resistance in the first communication paths is higher than flow path resistance in the second communication paths.

According to another aspect of the present disclosure, a liquid ejecting head includes nozzles configured to eject liquid, pressure chambers communicating with the nozzles, the pressure chambers being configured to generate pressure for ejecting the liquid, a first liquid chamber configured to store the liquid to be supplied to the pressure chambers, a second liquid chamber configured to store the liquid that passed through the pressure chambers, first communication paths communicating with the pressure chambers from the first liquid chamber, second communication paths respectively communicating with the second liquid chamber from between the pressure chambers and the nozzles, in which flow path resistance in the first communication paths is higher than flow path resistance in the second communication paths.

In the liquid ejecting head according to some aspect of the present disclosure, flow path resistance in the first communication paths is higher than flow path resistance in the second communication paths, and thus pressure vibration (in particular, remaining vibration) in the liquid generated in the pressure chambers can be effectively attenuated in the first communication paths, whereas flow path resistance in the second communication paths is lower than flow path resistance in the first communication paths, and thus the nozzles can be more smoothly refilled with the liquid from the second liquid chamber side through the second communication paths. With this structure, both of the increase in the performance in refilling the nozzles with the liquid and the reduction in the residual vibration can be achieved.

In the liquid ejecting head according to this aspect, inertance in the second communication paths may be higher than inertance in the nozzles.

With this structure, inertance in the second communication paths is higher than inertance in the nozzles, and the pressure vibration generated in the pressure chambers is more readily propagated toward the nozzle side than the second communication paths side. Accordingly, the loss of pressure vibration energy can be reduced and the liquid can be more efficiently ejected from the nozzles. Furthermore, the propagation of the pressure vibration through the second communication paths toward the second liquid chamber side can be suppressed, and the adverse effect of changing the ejection characteristic of the nozzles due to the pressure vibration propagated through the second liquid chamber toward other nozzles can be reduced.

In the liquid ejecting head, the second communication paths may communicate with nozzle communication paths that communicate with the pressure chambers and the nozzles, and a flow-path cross-sectional area of each second communication path may be smaller than a flow-path cross-sectional area of each nozzle communication path.

With this structure, when a flow of the liquid from the first liquid chamber side through the first communication paths, the pressure chambers, and the second communication paths toward the second liquid chamber is generated, the velocity of flow in the second communication paths is higher than the velocity of flow in the nozzle communication paths. Consequently, when bubbles enter the liquid from the nozzles, the bubbles can be immediately discharged from the second communication paths toward the second liquid chamber.

In the liquid ejecting head, a flow path plate having the nozzle communication paths may be a single substrate.

In this structure, a flow path plate having the nozzle communication paths is a single substrate and thus the length of the nozzle communication paths can be reduced and the specific vibration cycle of the pressure vibration between the pressure chambers and the nozzles can be reduced. With this structure, the responsivity to a liquid pressure change in the flow paths can be increased and a response to driving at a higher driving frequency can be performed. Furthermore, as compared to a flow path plate made by laminating a plurality of thin plates to have the same thickness as the flow path plate, the risk of deformation, breakage, or the like of the flow path plate can be reduced.

In the liquid ejecting head, portions of a wall surface defining the second liquid chamber may be second liquid-chamber flexible portions that deform in accordance with a change in pressure in the liquid in the second liquid chamber.

In this structure, portions of a wall surface defining the second liquid chamber are second liquid-chamber flexible portions that deform in accordance with a change in pressure in the liquid in the second liquid chamber. Consequently, when pressure vibration propagates through the second communication paths to the second liquid chamber, the flexible portions can suppress the pressure vibration, and thereby the adverse effect of changing the ejection characteristic of the nozzles due to the pressure vibration propagated through the second liquid chamber toward other nozzles can be further effectively reduced.

In the liquid ejecting head, portions of a wall surface defining the first liquid chamber may be first liquid-chamber flexible portions that deform in accordance with a change in pressure in the liquid in the first liquid chamber.

Furthermore, in the liquid ejecting head, the area of the second liquid-chamber flexible portions may be larger than the area of the first liquid-chamber flexible portions.

With this structure, the pressure vibration propagated from the second communication paths toward the second liquid chamber side can be further effectively attenuated.

A liquid ejecting apparatus according to another aspect of the present disclosure includes any one of the above-described liquid ejecting heads.

The liquid ejecting apparatus may also include a liquid feeding mechanism configured to, in an ejecting operation for ejecting the liquid from the nozzles of the liquid ejecting head, generate a flow of the liquid from the first liquid chamber side through the first communication paths, the pressure chambers, and the second communication paths toward the second liquid chamber side.

With this structure, a flow of the liquid from the first liquid chamber side through the first communication paths, the pressure chambers, and the second communication paths toward the second liquid chamber side can be generated in an ejecting operation. By the flow, when bubbles enter the liquid from the nozzles, the bubbles can be immediately discharged from the second communication paths toward the second liquid chamber side, and thus the movement of the bubbles toward the pressure chamber side can be prevented or reduced.

DESCRIPTION OF EXEMPLARY EMBODIMENTS

Hereinafter, embodiments of the disclosure will be described with reference to the attached drawings. Although the following embodiments describe various limitations as preferred embodiments of the disclosure, it is to be understood that the scope of the disclosure is not limited to the embodiments unless otherwise specifically described to limit the disclosure in the following description. In the description below, as an example liquid ejecting apparatus according to an embodiment of the present disclosure, an ink jet recording apparatus (hereinafter, referred to as a printer) 1 including an ink jet recording head (hereinafter, referred to as a recording head) 2 that is an example liquid ejecting head will be described.

Figure 1:
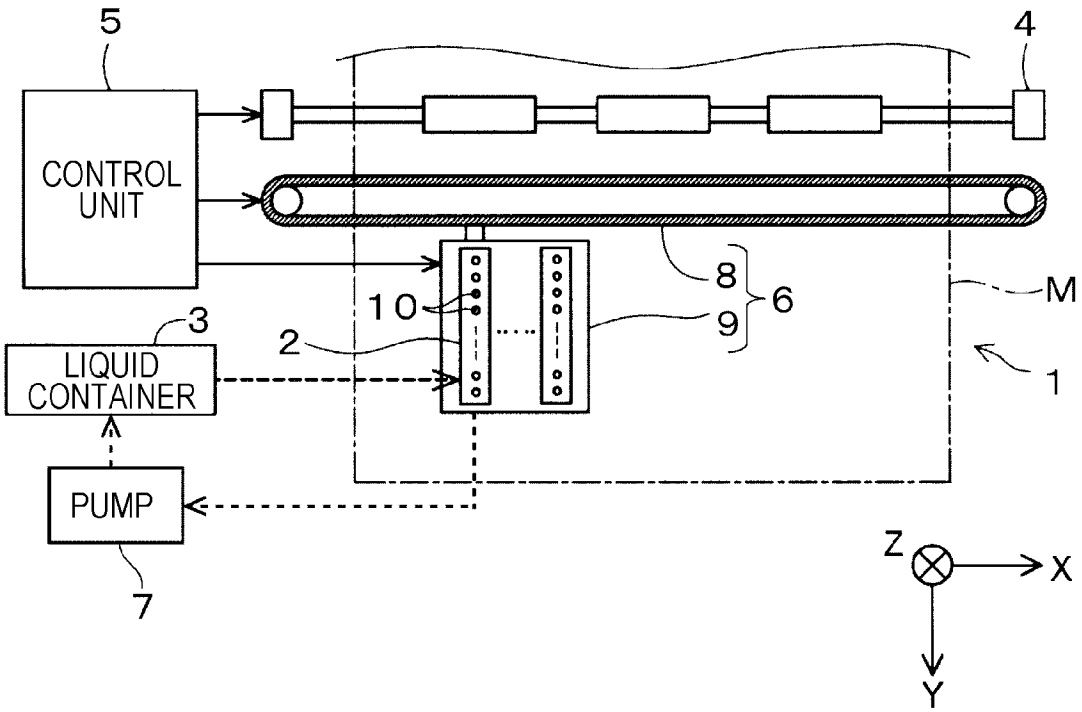
FIG. 1 is a schematic view of a structure of a liquid ejecting apparatus according to an embodiment.

FIG. 1 illustrates a schematic structure of the printer 1 according to an embodiment of the present disclosure. The printer 1 is an ink jet printing apparatus that ejects droplets of an ink, which is an example liquid, onto a print medium M to print an image or the like with the dot arrays formed onto the print medium M. The print medium M may be printing paper, or a print target of any material such as a resin film or cloth, and the printer 1 according to the embodiment performs printing onto various print media M. In the description below, among an X direction, a Y direction, and Z direction that are orthogonal to each other, the X direction denotes a moving direction (main scanning direction) along which the recording head 2, which will be described below, moves, the Y direction denotes a transport direction (sub-scanning direction) that is orthogonal to the main scanning direction, the Y direction along which a print medium M is transported, and the Z direction denotes a direction orthogonal to an X-Y plane.

The printer 1 includes a liquid container 3, a pump 7, a transport mechanism 4 for feeding a print medium M, a control unit 5, a head moving mechanism 6, and the recording head 2. The liquid container 3 stores separately a plurality of types (for example, a plurality of colors) of ink to be ejected from the recording head 2. The liquid container 3 may be a pouch-shaped ink pack formed of a flexible film, or an ink tank that can be refilled with ink. The pump 7 may be, for example, a tube pump, and serves as a liquid feeding mechanism according to the embodiment of the present disclosure for feeding, that is, circulating an ink through the liquid container 3 and the recording head 2. The control unit 5 includes a processing circuit such as a central processing unit (CPU) or a field programmable gate array (FPGA), and a storage circuit such as a semiconductor memory, and performs overall control of the transport mechanism 4, the head moving mechanism 6, the recording head 2, and the like. The transport mechanism 4 operates under the control of the control unit 5 to feed a print medium M in the Y direction, which is the transport direction. The head moving mechanism 6 includes a transport belt 8 that is looped around in the X direction over a print area of a print medium M and a carriage 9 that accommodates the recording head 2 and fixes the recording head 2 with respect to the transport belt 8. The head moving mechanism 6 operates under the control of the control unit 5 to reciprocate the recording head 2 mounted on the carriage 9 along a guide rail (not illustrated) along the X direction, which is the main scanning direction. The liquid container 3 may be mounted on the carriage 9 together with the recording head 2.

The recording head 2 according to the embodiment is provided for each ink color stored in the liquid container 3, and ejects an ink supplied from the liquid container 3 from a plurality of nozzles 10 toward a print medium M under the control of the control unit 5. The recording head 2 according to the embodiment includes a nozzle array of the nozzles 10 arranged in the sub-scanning direction, that is, Y direction.

Figure 2:
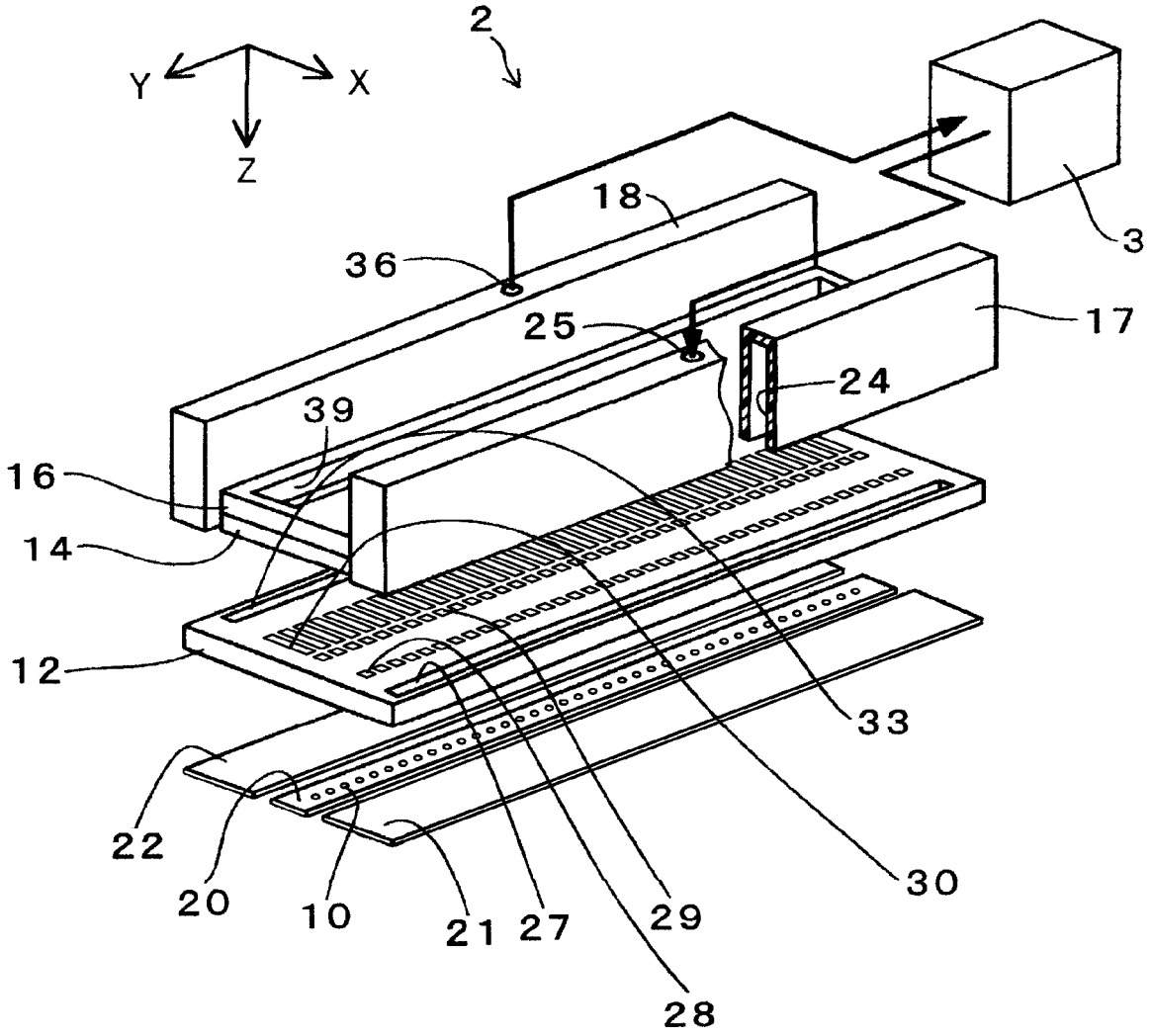
FIG. 2 is a perspective view of a structure of a liquid ejecting head according to an embodiment.
Figure 3:
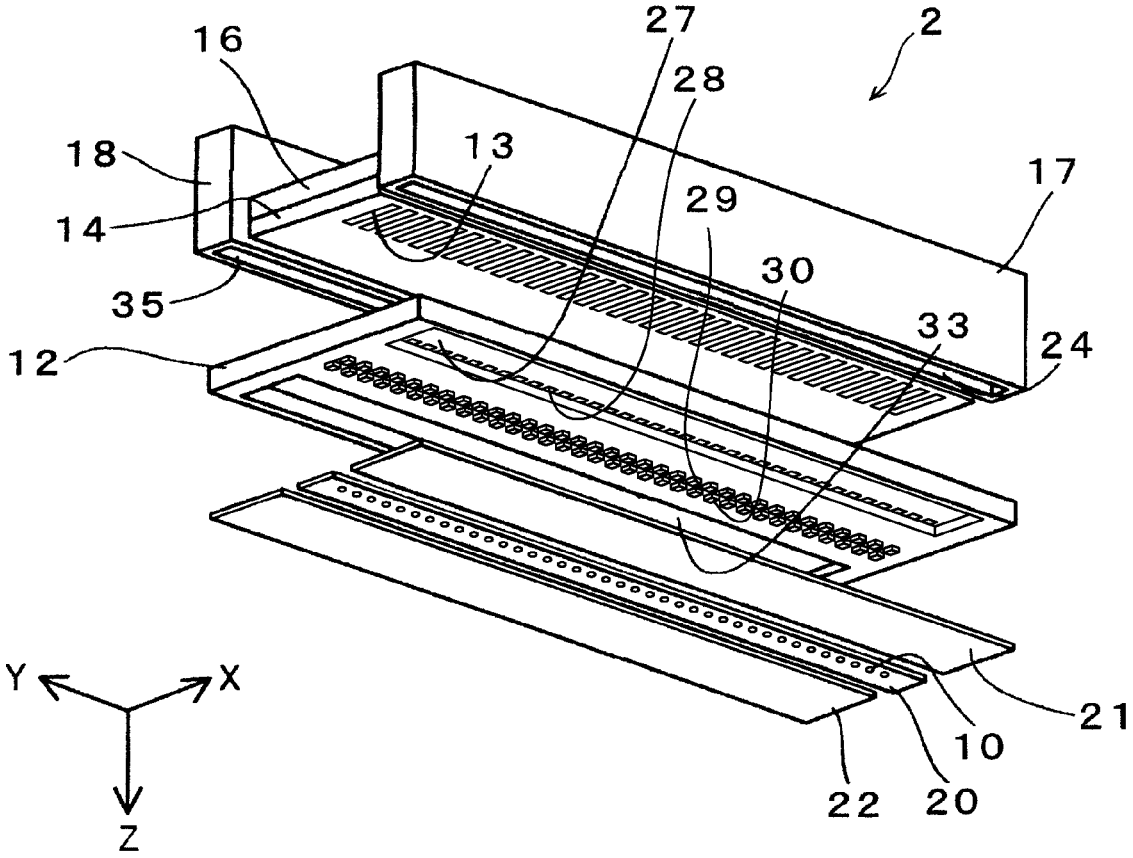
FIG. 3 is a perspective view of a structure of a liquid ejecting head according to an embodiment.
Figure 4:
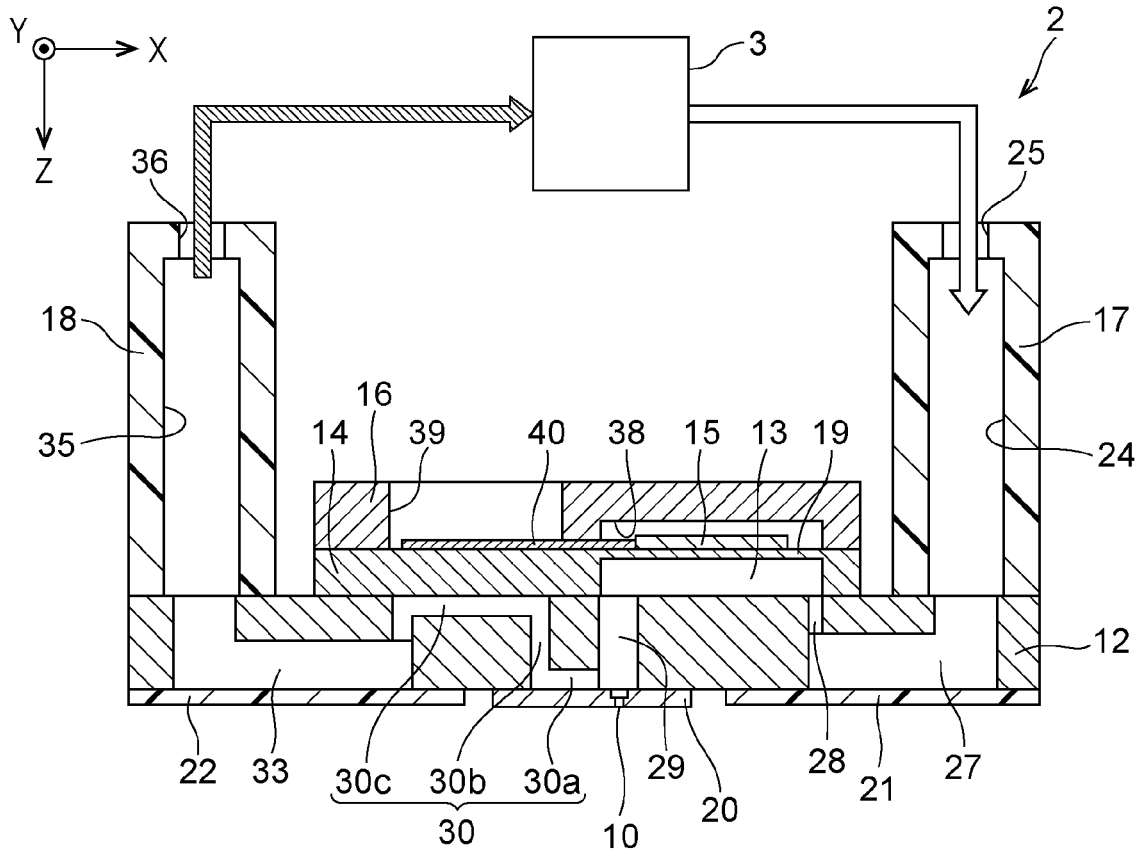
FIG. 4 is a cross-sectional view of a structure of a liquid ejecting head according to an embodiment.

FIG. 2 is an exploded perspective view illustrating the recording head 2 viewed obliquely from above. FIG. 3 is an exploded perspective view illustrating the recording head 2 viewed obliquely from below. FIG. 4 is a cross-sectional view illustrating the recording head 2. The recording head 2 according to the embodiment includes a flow path plate 12 having various flow paths, a nozzle plate 20 having the nozzles 10, a pressure chamber plate 14 having pressure chambers 13, a protection plate 16 for protecting piezoelectric elements 15, which serves as a pressure generating section or actuator described below, a supply flow path plate 17 for ink supply, and a collection flow path plate 18 for ink collection. Although the supply flow path plate 17 and the collection flow path plate 18 according to the embodiment are separated parts, the structure is not limited to the example, and may be integrally formed.

The flow path plate 12 according to the embodiment is a plate material longer in the Y direction than in the X direction in plan view from the Z direction. To both edges of an upper surface of the flow path plate 12 in a widthwise direction (the X direction in this embodiment), the supply flow path plate 17 and the collection flow path plate 18 are attached respectively, and to a region between the supply flow path plate 17 and the collection flow path plate 18, the pressure chamber plate 14 and the protection plate 16 are fixed in a laminated state. The nozzle plate 20 is joined to a central portion of a lower surface of the flow path plate 12 in the X direction, and a first compliance plate 21 and a second compliance plate 22 are joined such that the nozzle plate 20 is interposed therebetween.

The supply flow path plate 17 is a member having an ink introduction chamber therein. The ink introduction chamber 24 is open on a lower surface of the supply flow path plate 17, and the opening is blocked by the flow path plate 12, and thereby the ink introduction chamber 24 is defined. The ink introduction chamber 24 introduces an ink supplied from the liquid container 3 through an inlet 25 formed in an upper surface of the supply flow path plate 17 as indicated by a white arrow in FIG. 4.

The flow path plate 12 according to the embodiment is, for example, a single substrate made of a silicon single crystal substrate, or the like. The flow path plate 12 has, from the side on which the supply flow path plate 17 is joined, a common liquid chamber 27 (a first liquid chamber according to the embodiment of the present disclosure), a first individual communication path 28 (a first communication path according to the embodiment of the present disclosure), a nozzle communication path 29, a second individual communication path 30 (a second communication path according to the embodiment of the present disclosure), and a common collection liquid chamber 33 (a second liquid chamber according to the embodiment of the present disclosure).

The common liquid chamber 27 extends along the nozzle array direction of the nozzle 10, that is, along the Y direction, and is a liquid chamber communicating with a plurality of pressure chambers 13. Specifically, the common liquid chamber 27 is a liquid chamber that is commonly used for ink supply for the nozzles 10. The opening of the common liquid chamber 27 on the upper surface of the flow path plate 12 communicates with the ink introduction chamber 24 of the supply flow path plate 17. The opening of the common liquid chamber 27 on the lower surface of the flow path plate 12 is blocked by the first compliance plate 21, which will be described below, joined to the lower surface. A plurality of first individual communication paths 28 are provided to correspond to the pressure chambers 13 respectively, and are through holes that communicate with the pressure chambers 13 in the pressure chamber plate 14 and the common liquid chamber 27. In other words, the first individual communication paths 28 communicate with the common liquid chamber 27 and the pressure chambers 13. The first individual communication path 28 has a flow-path cross-sectional area smaller than those of other parts in the flow path from the liquid container 3 to the pressure chamber 13, and applies a flow path resistance to the ink passing through the first individual communication path 28.

The pressure chamber 13 in the pressure chamber plate 14 is a liquid chamber long in the X direction and is open in the lower surface of the pressure chamber plate 14. The pressure chamber plate 14 is joined to the upper surface of the flow path plate 12, blocking the opening and defining the pressure chamber 13. In the pressure chamber plate 14, on the upper surface side of the pressure chamber 13, a flexible diaphragm 19 is provided. The diaphragm 19 is a thin-plate like portion that can be deformed in accordance with the drive of the piezoelectric element 15 that serves as a pressure generating section, and provided for each pressure chamber 13. On each diaphragm 19, the piezoelectric element 15 is provided. The piezoelectric elements 15 correspond to the respective nozzles 10, and are drive elements that deform in accordance with drive signals from the control unit 5. The deformation of the piezoelectric element 15 causes the diaphragm 19 to deform, changing the volume of the pressure chamber 13, and thereby pressure vibration occurs in the ink in the pressure chamber 13. The recording head 2 uses the pressure vibration to eject liquid droplets, that is, ink droplets, from the nozzles 10.

The first compliance plate 21 absorbs the pressure vibration that propagates from the pressure chambers 13 to the inside of the common liquid chamber 27 in ejecting ink droplets from the nozzles 10 to suppress variations in the ejection characteristics (the amount of ink droplets, the ejection speed, and the like) of the nozzles 10. Each of the first compliance plate 21 and the second compliance plate 22, which will be described below, has a thin film (not illustrated) made of, for example, a flexible resin. The thin film may have a thickness of 20 μm or less and may be made of a material having a high ink resistance such as polyphenylene sulfide (PPS), aromatic polyamide (aramid), aromatic polyimide, or the like. This thin film deforms in accordance with the pressure vibration of the ink in the liquid chamber, absorbing the pressure vibration. Hereinafter, in the compliance plates 21 and 22, portions that deform in accordance with pressure vibration in the liquid chambers and substantially contributes to the absorption of the pressure vibration may be referred to as compliance portions as appropriate. The compliance portions in the first compliance plate 21 correspond to first liquid-chamber flexible portions according to the embodiment of the present disclosure, and the compliance portions in the second compliance plate 22 correspond to second liquid-chamber flexible portions according to the embodiment of the present disclosure.

The nozzle communication path 29 in the flow path plate 12 is a through hole in the flow path plate 12, and connects the nozzle 10 in the nozzle plate 20 that is joined to the lower surface of the flow path plate 12 and the pressure chamber 13 in the pressure chamber plate 14 that corresponds to the nozzle 10 on the side of the other end of the pressure chamber. The length of the flow path of the nozzle communication path 29 is determined by the thickness of the flow path plate 12. In this embodiment, since the flow path plate 12 having the nozzle communication path 29 is a single substrate and the length of the nozzle communication path 29 is short, the specific vibration cycle of the pressure vibration between the pressure chamber 13 and the nozzle 10 can be reduced. With this structure, the responsivity to an ink pressure change in the flow path from the pressure chamber 13 to the nozzle 10 can be increased and a response to driving at a higher driving frequency, that is, the ejection of liquid droplets in a shorter cycle, can be achieved. Furthermore, for example, as compared to a flow path plate made by laminating a plurality of thin plates to have the same thickness as the flow path plate 12 according to the embodiment, the risk of deformation, breakage, or the like of the flow path plate 12 can be reduced. Furthermore, since the steps of laminating plates, or the like can be eliminated, the flow path plate is cost effective.

The nozzle plate 20 is joined to the lower surface of the flow path plate 12, so that the openings of the nozzle communication paths 29 and the second individual communication paths 30, which will be described below, are blocked. The nozzle plate 20 according to the embodiment has the nozzles 10 formed in a row, for example, by dry etching, wet etching, or the like performed to a single crystal substrate of silicon (Si). The nozzle 10 is a circular through hole for ejecting ink; however, may be any known shape.

The second individual communication path 30 is a flow path that corresponds to the individual nozzle 10, and has a groove shape made by wet etching or the like performed to the flow path plate 12. The second individual communication path 30 is a flow path that corresponds to the individual nozzle 10, and communicates with the nozzle communication path 29, which connects the pressure chamber 13 and the nozzle 10, and the common collection liquid chamber 33. The second individual communication path 30 has a flow-path cross-sectional area smaller than those of other parts in the flow path from the pressure chamber 13 to the nozzle 10 or the liquid container 3, and applies a flow path resistance to the ink passing through the second individual communication path 30. The second individual communication path 30 according to the embodiment includes a first horizontal path 30*a* that communicates with the nozzle communication path 29 at one end and extends in the X direction on the lower surface of the flow path plate 12, a vertical path 30*b* that communicates with the other end of the first horizontal path 30*a* on the lower surface of the flow path plate 12 and extends through the flow path plate 12 in the Z direction, which is the thickness direction of the flow path plate 12, and a second horizontal path 30*c* that communicates with the vertical path 30*b* at one end on the upper surface of the flow path plate 12 and communicates with the common collection liquid chamber 33 at the other end and extends in the X direction.

The common collection liquid chamber 33 is a liquid chamber that extends along the Y direction, and communicates with the nozzles 10 through the nozzle communication paths 29 and the second individual communication paths 30. Specifically, the common collection liquid chamber 33 is a liquid chamber that is commonly used by the nozzles 10. The common collection liquid chamber 33 may be also referred to as a common liquid chamber that communicates with the pressure chambers 13. An opening of the common collection liquid chamber 33 on the upper surface side of the flow path plate 12 communicates with an ink outlet chamber 35 in the collection flow path plate 18, and an opening of the common collection liquid chamber 33 on the lower surface side of the flow path plate 12 is blocked by the second compliance plate 22. The area of the opening of the common collection liquid chamber 33 on the lower surface of the flow path plate 12 is larger than the area of the opening of the common liquid chamber 27 on the lower surface of the flow path plate 12. Consequently, the area of the compliance portions (second liquid-chamber flexible portions) that contribute to the absorption of the pressure vibration in the common collection liquid chamber 33 in the second compliance plate 22 is larger than the area of the compliance portions (first liquid-chamber flexible portions) that contribute to the absorption of the pressure vibration in the common liquid chamber 27 in the first compliance plate 21.

The collection flow path plate 18 has the ink outlet chamber 35 in the collection flow path plate 18. The ink outlet chamber 35 is open on a lower surface of the collection flow path plate 18 and communicates with the common collection liquid chamber 33 in the flow path plate 12. The ink outlet chamber 35 returns, as indicated by a hatched arrow in FIG. 4, the ink discharged from the side of the common collection liquid chamber 33 through an outlet 36 on an upper surface of the collection flow path plate 18 to the liquid container 3.

The protection plate 16 has concave housing spaces 38 that correspond to the areas where the piezoelectric elements 15 are provided on the diaphragm 19 in the pressure chamber plate 14. The protection plate 16 is joined to the upper surface of the pressure chamber plate 14 in a state in which the piezoelectric elements 15 are housed in the housing spaces 38. The protection plate 16 has a wiring through hole 39 that is a through hole extending in the plate thickness direction and is used for installation of a wiring board (not illustrated) connected to lead electrodes 40 extending from the piezoelectric elements 15.

The recording head 2 having such a structure is refilled with the ink supplied from the liquid container 3 by the operation of the pump 7 via the ink introduction chamber 24 in the supply flow path plate 17 to the common liquid chamber 27 in the flow path plate 12. The ink in the common liquid chamber 27 is supplied via the first individual communication paths 28, which are flow paths individually provided for the nozzles 10, to the corresponding pressure chambers 13. In response to driving of the piezoelectric elements 15 in accordance with the waveforms of a drive signal from the control unit 5, the diaphragms 19 are deformed, and the volume of the pressure chambers 13 is changed, and thereby pressure vibration occurs in the ink in the pressure chambers 13. The pressure vibration propagates from the pressure chambers 13 toward the nozzles 10, and when the pressure vibration becomes maximum, the ink is ejected from the nozzles 10 as ink droplets. The ink that has passed through the pressure chambers 13 and has not been ejected from the nozzles 10 is sent from the nozzle communication path 29 via the second individual communication path 30 to the common collection liquid chamber 33, and further sent to the ink outlet chamber 35 in the collection flow path plate 18. Then, the ink in the ink outlet chamber 35 is returned from the outlet 36 to the liquid container 3.

The ink circulation continues during the execution of the print job (printing operation), that is, while the ejection of ink from the nozzles 10 is performed. Specifically, in an ejecting operation of ejecting an ink from the nozzles 10, by the operation of the pump 7, the recording head 2 according to the embodiment generates a flow of ink from the common liquid chamber 27 through the first individual communication paths 28, the pressure chambers 13, and the second individual communication paths 30 toward the common collection liquid chamber 33. Consequently, when bubbles are trapped in the ink in the nozzles 10 due to a print medium coming into contact with the openings of the nozzles 10, or the like, the bubbles can be immediately discharged from the second individual communication paths 30 toward the common collection liquid chamber 33. As a result, the problem that such bubbles move toward the pressure chambers 13 and the removal of the bubbles becomes difficult can be reduced. In this embodiment, furthermore, the flow-path cross-sectional area of the second individual communication path 30 is smaller than the flow-path cross-sectional area of the nozzle communication path 29. Accordingly, the velocity of flow in the second individual communication path 30 in the ink circulation is higher than the velocity of flow in the nozzle communication path 29. With this structure, when bubbles are trapped in the ink in the nozzles 10, the bubbles can be immediately discharged from the second individual communication paths 30 toward the common collection liquid chamber 33. Note that the direction of the ink circulation is not limited to the illustrated direction, and may be a reverse direction. For example, a flow from the common collection liquid chamber 33 through the second individual communication paths 30, the nozzle communication paths 29, the pressure chambers 13, the first individual communication paths 29, toward the common liquid chamber 27 may be generated.

Although the ink ejected by the nozzle 10 is lost immediately after the ink ejection from the ink nozzle 10, in the process that the meniscus that is the surface of the ink in the nozzle 10 returns from a position recessed toward the pressure chamber 13 to an initial position before the ejection, the ink in the common liquid chamber 27 is supplied through the first individual communication path 28 toward the pressure chamber 13, and the ink in the common collection liquid chamber 33 is supplied through the second individual communication path 30 toward the nozzle 10. In particular, since the second individual communication path 30 is closer to the nozzle 10 than the first individual communication path 28, in order to increase the ink refilling performance to the nozzle 10, it is preferable that the ink in the common collection liquid chamber 33 smoothly flow through the second individual communication path 30 toward the nozzle 10 side, that is, the ink refilling performance be increased. Meanwhile, the pressure vibration for ink ejection is generated in the pressure chamber 13. The pressure vibration include the pressure vibration that propagates through the first individual communication path 28 toward the common liquid chamber 27, the pressure vibration that is used for ejection of ink droplets from the nozzle 10, and the pressure vibration that propagates through the second individual communication path 30 toward the common collection liquid chamber 33. In order to suppress the fluctuation in the amount of droplets ejected from the nozzle 10 and the flying speed to more stably eject the ink, it is required that the residual vibration be reduced as much as possible.

In view of the above, the recording head 2 according to the embodiment of the present disclosure is designed to have appropriate flow path resistance in the first individual communication path 28 and the second individual communication path 30 to achieve both of the increase in the ink refilling performance and the reduction in the residual vibration. When the shape of the flow path can be approximated to a rectangular parallelepiped, the flow path resistance R in the flow path is obtained by the following equation (1):

$$R = \frac{12\ \mu L}{WH^3} \tag{1}$$

where L is the length of the flow path in the ink flow direction, W is the width of the flow path, H is the height of the flow path, and μ is the viscosity of ink. When the shape of the flow path is cylindrical, the flow path resistance R is obtained by the following equation (2):

$$R = \frac{128\ \mu L}{\pi d^4} \tag{2}$$

where d is the diameter of the flow path. When the shape of the flow path is not a perfect circle, the flow path resistance R can be obtained using the diameter d obtained from the flow-path cross-sectional area on the assumption that the shape is a perfect circle. When the flow-path cross-sectional area is not constant, the flow path resistance R can be obtained by the following equation (3).

$$R = \int_0^L \frac{128\mu}{\pi d^4} dx \tag{3}$$

The recording head 2 according to the embodiment of the present disclosure is designed such that a flow path resistance R1 in the first individual communication path 28 is higher than a flow path resistance R2 in the second individual communication path 30. The flow path resistance set in this manner provides the flow path resistance R1 that is higher than the flow path resistance R2 in the first individual communication path 28 that is closer to the pressure chamber 13, which is the source of the pressure vibration, than the second individual communication path 30. Accordingly, the residual vibration can be more effectively attenuated by the viscosity of the ink. On the other hand, in the second individual communication path 30, which is closer to the nozzle 10 than the first individual communication path 28, the flow path resistance R2 is lower than the flow path resistance R1. Accordingly, the ink can be supplied more quickly from the common collection liquid chamber 33 side toward the nozzle 10 side, and the ink refilling performance can be increased. Consequently, in the recording head 2 designed to circulate an ink through the liquid container 3, both of the increase in the performance in refilling the nozzles 10 with the ink and the reduction in the residual vibration can be achieved. As a result, while the variations in the ejection characteristics of ink droplets in the nozzles 10 is suppressed, more stable ink droplet ejection can be performed.

Furthermore, in the recording head 2 according to the embodiment, the opening on the lower surface side of the common liquid chamber 27 is blocked by the first compliance plate 21, and the opening on the lower surface side of the common collection liquid chamber 33 is blocked by the second compliance plate 22. With this structure, the pressure vibration generated in the ink stored in the common liquid chamber 27 is attenuated by the bending and deformation of the compliance portions in the first compliance plate 21. Similarly, the pressure vibration generated in the ink stored in the common collection liquid chamber 33 is attenuated by the bending and deformation of the compliance portions in the second compliance plate 22. As a result, so-called crosstalk that the pressure vibration (in particular, the remaining vibration) due to the ink ejection in certain nozzles 10 propagate through the common liquid chamber 27 and the common collection liquid chamber 33 and adversely affects the other nozzles 10 can be suppressed. In this embodiment, the flow path resistance R2 is lower than the flow path resistance R1, and the pressure vibration is less attenuated in the individual communication path 30 (however, as will be described below, the pressure vibration is not readily propagated through the individual communication path 30 toward the common collection liquid chamber 33); however, by the second compliance plate 22, the pressure vibration can be attenuated. Furthermore, as described above, the area of the compliance portions (the second liquid-chamber flexible portions) in the second compliance plate 22 is larger than the area of the compliance portions (the first liquid-chamber flexible portions) in the first compliance plate 21. Consequently, the pressure vibration propagated through the individual communication paths 30 toward the common collection liquid chamber 33 can be more effectively attenuated. In this embodiment, the compliance plates 21 and 22 provided for the common liquid chamber 27 and the common collection liquid chamber 33 respectively further effectively reduce the adverse effect that the pressure vibration propagates through the common collection liquid chamber 33 toward the other nozzles 10 and changes the ejection characteristic of the nozzles 10.

The recording head 2 according to the embodiment of the present disclosure is designed to have appropriate inertance in the first individual communication paths 28 and the nozzles 10 so as to suppress the escape of pressure vibration from the pressure chambers 13 toward the common collection liquid chamber 33 side and to allow the pressure vibration to readily propagate toward the nozzles 10 side, enabling more effective ink droplet ejection. Increased inertance M in the flow paths works as the resistance to the pressure vibration that changes greatly in a short time, and thus reducing the propagation of the pressure vibration with such a great momentary change in vibration. The inertance M in the flow path can be expressed by the following equation (4):

$$M = \frac{\rho L}{S} \tag{4}$$

where ρ is the ink density and S is the flow-path cross-sectional area S. When the flow-path cross-sectional area is not constant, the inertance M can be obtained by the following equation (5).

$$M = \int_0^L \frac{\rho}{S} dx \tag{5}$$

The recording head 2 according to the embodiment of the present disclosure is designed such that inertance M2 in the second individual communication paths 30 is higher than inertance Mn in the nozzles 10. Such inertance reduces the propagation of the pressure variation that indicates a momentary change in pressure in ejecting ink droplets from the nozzles 10 through the second individual communication paths 30 toward the common collection liquid chamber 33, enabling the pressure vibration to more readily propagate toward the nozzles 10 by the amount. Consequently, the loss of pressure vibration energy can be reduced and the ink can be more efficiently ejected from the nozzle 10.

Figure 5:
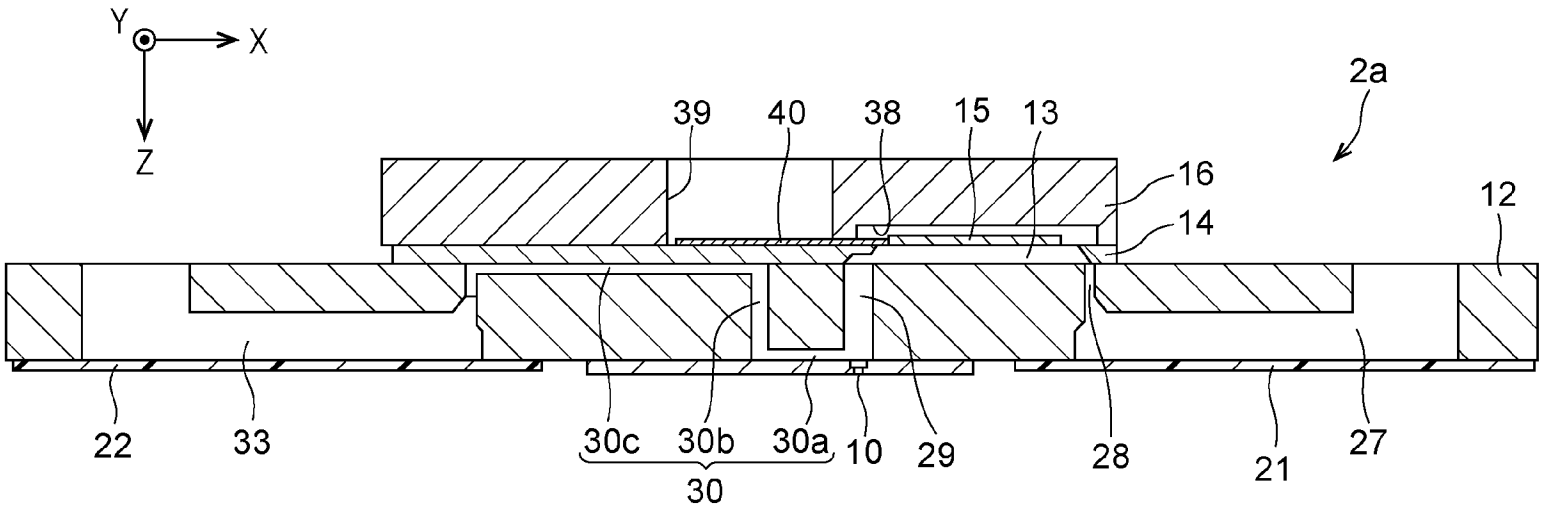
FIG. 5 is a cross-sectional view of a structure of a liquid ejecting head according to a second embodiment.

FIG. 5 is a cross-sectional view of a recording head 2*a* according to a second embodiment. In the following descriptions, to components having structures and functions similar to those in the first embodiment, the same reference numerals are given respectively, and the descriptions thereof are omitted as appropriate (the same applies to a third embodiment and a fourth embodiment described below). Note that the illustration of the supply flow path plate 17 and the collection flow path plate 18 is omitted. In the recording head 2*a* according to the embodiment, the flow path plate 12, which is a single substrate, is longer in the X direction with respect to the pressure chamber plate 14. The flow path length of the second individual communication path 30 is increased in length to correspond to the flow path plate 12 as compared to the structure according to the first embodiment. With respect to the second individual communication path 30 according to the embodiment, among the first horizontal path 30*a*, the vertical path 30*b*, and the second horizontal path 30*c*, in particular, the flow path length of the second horizontal path 30*c* is long, and the total flow path length (that is, the overall length of the flow path) of the second individual communication path 30 is long. With this structure, the inertance M2 in the second individual communication path 30 can be further increased. Such inertance M2 reduces the propagation of the pressure variation that indicates a momentary change in pressure in ejecting ink droplets from the nozzles 10 through the second individual communication paths 30 toward the common collection liquid chamber 33, enabling the pressure vibration to more readily propagate toward the nozzles 10 by the amount. Consequently, the loss of pressure vibration energy can be further reduced and the ink can be more efficiently ejected from the nozzle 10.

Figure 6:
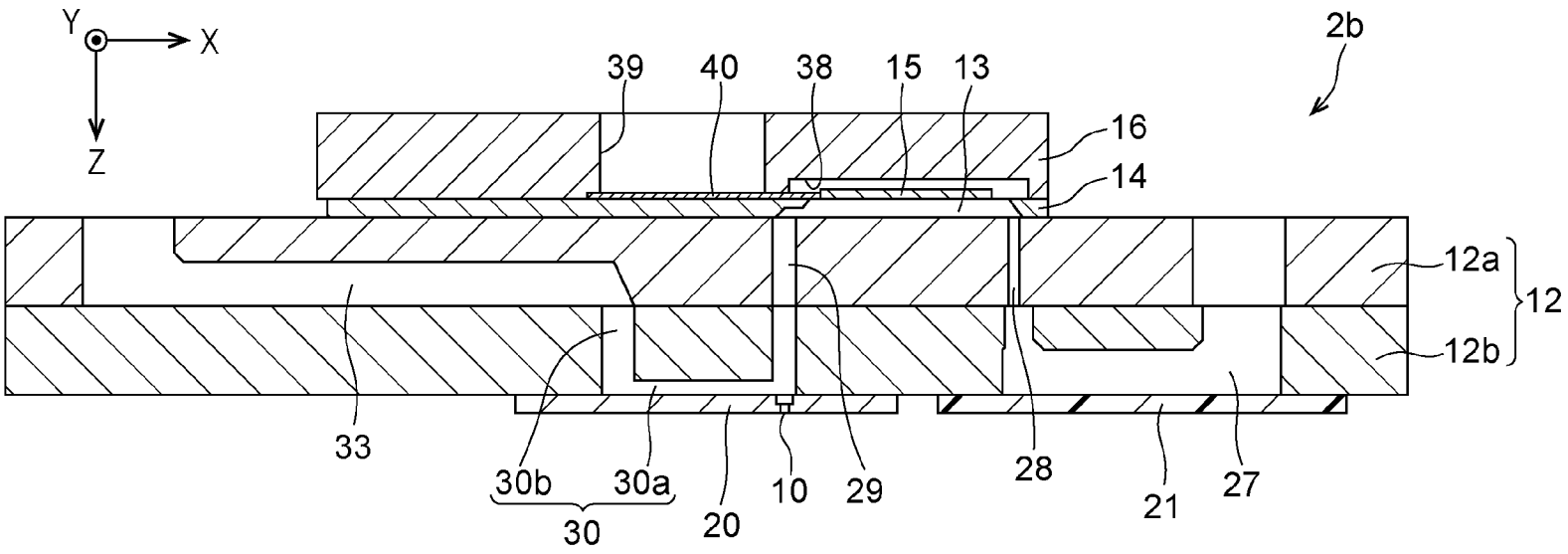
FIG. 6 is a cross-sectional view of a liquid ejecting head according to a third embodiment.

FIG. 6 is a cross-sectional view of a recording head 2*b* according to a third embodiment. In this embodiment, the flow path plate 12 is a laminate of a first flow path plate 12*a* on the side of the pressure chamber plate 14 and a second flow path plate 12*b* that is on the side of the nozzle plate 20 and laminated on the first flow path plate 12*a*. The first individual communication path 28 according to the embodiment is a through hole in the first flow path plate 12*a* in the Z direction. Specifically, in the first embodiment, the flow path length of the first individual communication path 28 is shorter than the thickness of the flow path plate 12, which is a single substrate, whereas in this embodiment, the flow path length of the first individual communication path 28 is defined by the thickness of the first flow path plate 12*a*, and thus the longer flow path length can be provided. With this structure, the flow path resistance R1 in the first individual communication path 28 can be further increased, and the attenuation effect of the residual vibration caused by the ink ejection can be increased.

Figure 7:
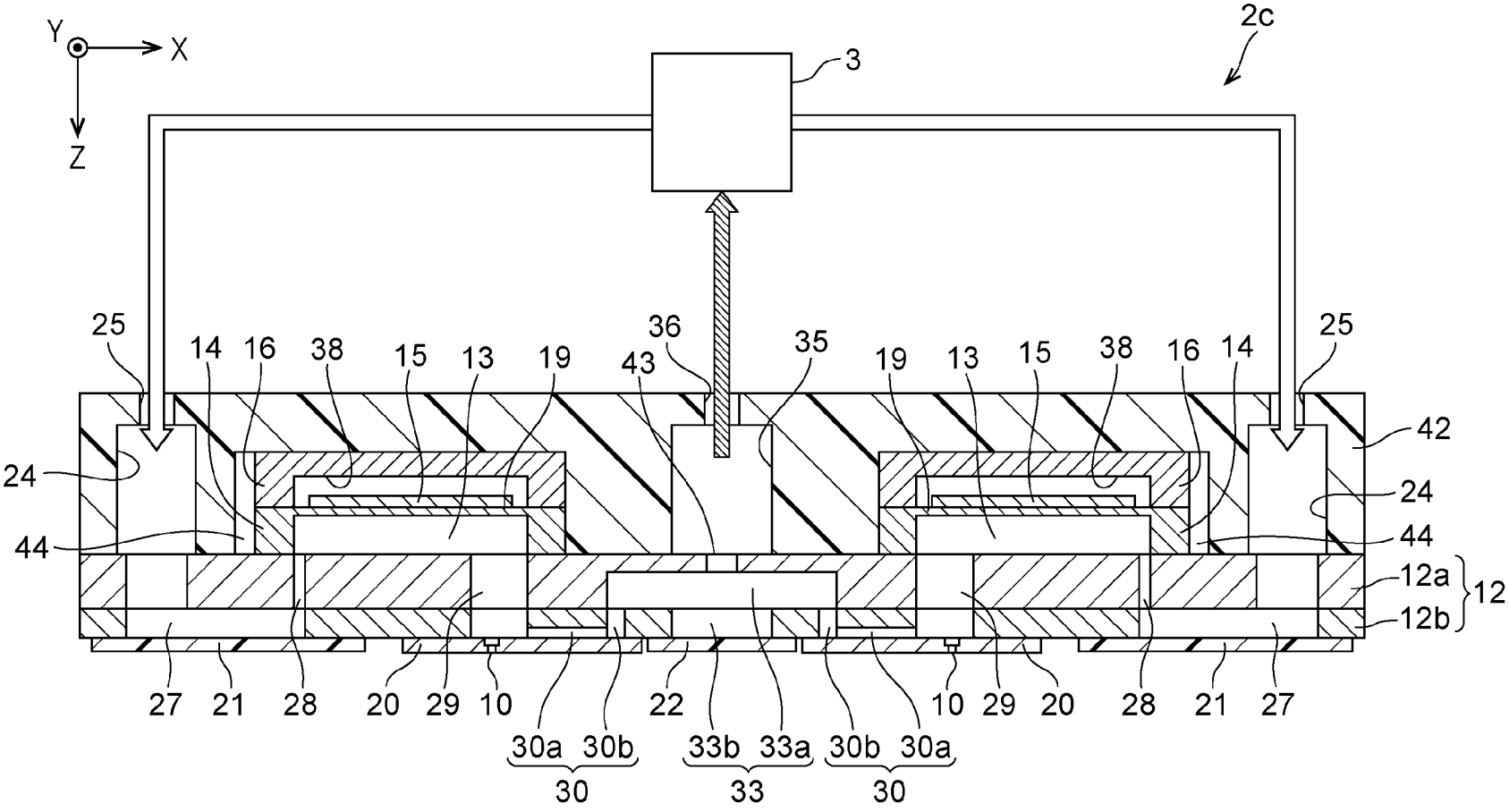
FIG. 7 is a cross-sectional view of a liquid ejecting head according to a fourth embodiment.

FIG. 7 is a cross-sectional view of a recording head 2*c* according to a fourth embodiment. In this embodiment, similarly to the third embodiment, the flow path plate 12 is a laminate of the first flow path plate 12*a* and the second flow path plate 12*b*. The recording head 2*c* according to the embodiment has two arrays of nozzles 10. The recording head 2*c* also has, to correspond to the two arrays of nozzles 10, two pairs of the inlets 25, ink introduction chambers 24, common liquid chambers 27, nozzle plates 20, and first compliance plates 21, and to correspond to the nozzles 10 in the nozzle arrays, the first individual communication paths 28, the pressure chambers 13, the nozzle communication paths 29, the second individual communication paths 30, the piezoelectric elements 15, and the like. In the recording head 2*c* according to the embodiment, the inlets 25, the ink introduction chambers 24, the ink outlet chamber 35, and the outlet 36 are formed, for example, in a plastic holder 42. On a lower surface of the holder 42, the flow path plate 12 is joined with the pressure chamber plate 14 and the protection plate 16 accommodated in a holding space 44.

In this embodiment, the common collection liquid chamber 33 and the second compliance plate 22 are provided between both nozzle arrays at corresponding positions (that is, a central portion in the X direction). The common collection liquid chamber 33 includes a first collection liquid chamber 33*a* formed in the first flow path plate 12*a* and a second collection liquid chamber 33*b* formed in the second flow path plate 12*b*. The common collection liquid chamber 33 communicates with the ink outlet chamber 35 in the holder 42 through a communication opening 43 on an upper surface side of the first flow path plate 12*a*. Each of the nozzles 10 in the nozzle arrays communicates with the common collection liquid chamber 33 from the nozzle communication path 29 through the second individual communication path 30. This embodiment employs one common collection liquid chamber 33 that is commonly used by the two nozzle arrays, and thus requires only one pair of the common collection liquid chamber 33 and the second compliance plate 22. Consequently, as compared to a structure in which the common collection liquid chambers 33 and the second compliance plates 22 are provided for each nozzle array, the size of the recording head 2 can be reduced.

Note that some embodiments of the present disclosure may be applied to a liquid ejecting head including a first liquid chamber, a first communication path, a pressure chamber, a nozzle, a second communication path, and a second liquid chamber, and a liquid ejecting apparatus having the liquid ejecting head. For example, some embodiments of the disclosure may be applicable to color material ejecting heads to be used to manufacture color filters for liquid crystal displays or the like, electrode material ejecting heads to be used to form electrodes for organic electro luminescence (EL) displays, field emission displays (FEDs), or the like, or liquid ejecting heads having bioorganic substance ejecting heads to be used to manufacture biochips (biochemical elements), or may be applicable to liquid ejecting apparatuses having any of these heads.

What is claimed is:

1. A liquid ejecting head comprising:

nozzles configured to eject liquid;

pressure chambers communicating with the nozzles, the pressure chambers being configured to generate pressure for ejecting the liquid;

a first liquid chamber configured to store the liquid to be supplied to the pressure chambers;

a second liquid chamber configured to store the liquid that passed through the pressure chambers;

first communication paths communicating with the pressure chambers from the first liquid chamber; and second communication paths respectively communicating with the second liquid chamber from between the pressure chambers and the nozzles, wherein a flow path resistance in each first communication path is higher than a flow path resistance in each second communication path, and wherein inertance in the second communication path is higher than inertance in the nozzle corresponding to the second communication path.

2. The liquid ejecting head according to claim 1, wherein each second communication path communicates with a nozzle communication path that communicates with the pressure chamber and each nozzle, and a flow-path cross-sectional area of each second communication path is smaller than a flow-path cross-sectional area of the nozzle communication path.

3. The liquid ejecting head according to claim 2, wherein a flow path plate having nozzle communication paths is a single substrate.

4. The liquid ejecting head according to claim 1, wherein a wall defining the second liquid chamber is a second liquid-chamber flexible portion that deforms in accordance with a change in pressure in the liquid in the second liquid chamber.

5. The liquid ejecting head according to claim 4, wherein a wall defining the first liquid chamber is a first liquid-chamber flexible portion that deforms in accordance with a change in pressure in the liquid in the first liquid chamber.

6. The liquid ejecting head according to claim 5, wherein the area of the second liquid-chamber flexible portion is larger than the area of the first liquid-chamber flexible portion.

7. The liquid ejecting head according to claim 1, wherein a length of each second communication path is longer than a length of each first communication path.

8. The liquid ejecting head according to claim 7, wherein each second communication path includes a first horizontal path that communicates with a nozzle communication path, a vertical path that communicates with the first horizontal path at a first end and a second horizontal path that communicates with a second end of the vertical path and with the second liquid chamber.

9. A liquid ejecting apparatus comprises the liquid ejecting head according to claim 1.

10. The liquid ejecting apparatus according to claim 9, further comprising:

a liquid feeding mechanism configured to, in an ejecting operation for ejecting the liquid from the nozzles of the liquid ejecting head, generate a flow of the liquid from the first liquid chamber side through the first communication paths, the pressure chambers, and the second communication paths toward the second liquid chamber side.

* * * * *